US010830024B2

(12) United States Patent
Collins et al.

(10) Patent No.: US 10,830,024 B2
(45) Date of Patent: Nov. 10, 2020

(54) METHOD FOR PRODUCING FROM GAS SLUGGING RESERVOIRS

(71) Applicant: GE Oil & Gas ESP, Inc., Oklahoma City, OK (US)

(72) Inventors: Charles Collins, Oklahoma City, OK (US); Stacy Wade, Purcell, OK (US); Darrel Clark, Oklahoma City, OK (US); Eric Rohlman, Oklahoma City, OK (US)

(73) Assignee: GE Oil & Gas ESP, Inc., Oklahoma City, OK (US)

( * ) Notice: Subject to any disclaimer, the term of this patent is extended or adjusted under 35 U.S.C. 154(b) by 378 days.

(21) Appl. No.: 15/632,315

(22) Filed: Jun. 24, 2017

(65) Prior Publication Data

US 2018/0371884 A1 Dec. 27, 2018

(51) Int. Cl.

| | |
|---|---|
| ***E21B 43/12*** | (2006.01) |
| ***F04D 9/00*** | (2006.01) |
| ***F04D 15/00*** | (2006.01) |
| ***F04B 47/06*** | (2006.01) |
| ***F04B 49/06*** | (2006.01) |

(Continued)

(52) U.S. Cl.

CPC ..... *E21B 43/128* (2013.01); *E21B 47/008* (2020.05); *F04B 47/06* (2013.01); *F04B 49/065* (2013.01); *F04D 9/001* (2013.01); *F04D 13/086* (2013.01); *F04D 13/10* (2013.01); *F04D 15/0066* (2013.01); *F04D 15/0209* (2013.01); *F04B 2203/0209* (2013.01); *F05D 2270/335* (2013.01); *F17D 1/005* (2013.01)

(58) Field of Classification Search

CPC ..... E21B 43/128; E21B 47/0007; F05D 2270/335; F17D 1/005; F04D 9/001; F04D 47/06; F04D 49/065; F04D 15/0066; F04D 13/086; F04D 13/10; F04B 2203/0209

See application file for complete search history.

(56) References Cited

U.S. PATENT DOCUMENTS 5,015,151 A * 5/1991 Snyder, Jr. ..... E21B 43/128 417/18

8,746,353 B2 6/2014 Hughes (Continued)

FOREIGN PATENT DOCUMENTS

WO 2016205100 A1 12/2016

OTHER PUBLICATIONS

D.N. Alcock, Production Operation of Submersible Pumps with Closed-Loop Adjustable Speed Control, IEEE Transactions on Industry Applications, Sep. 1981.

(Continued)

*Primary Examiner* — Charles G Freay

(74) *Attorney, Agent, or Firm* — Crowe & Dunlevy

(57) ABSTRACT

A method of operating a submersible pumping system includes the steps of placing the pumping system in a normal mode of operation and then detecting the possible presence of a gas slug in proximity to the pumping system by measuring a decrease in the load on the motor. Once the possibility of a gas slug has been detected, the method continues by placing the pumping system in a reduced speed cycle. The pumping system is kept in the reduced speed cycle until the absence of a gas slug in proximity to the pumping system is detected by evaluating two independent conditions within the pumping system.

17 Claims, 5 Drawing Sheets

(51) Int. Cl.

| | |
|---|---|
| ***F04D 13/08*** | (2006.01) |
| ***F04D 13/10*** | (2006.01) |
| ***F04D 15/02*** | (2006.01) |
| ***E21B 47/008*** | (2012.01) |
| *F17D 1/00* | (2006.01) |

(56) References Cited

U.S. PATENT DOCUMENTS

| | | | | |
|---|---|---|---|---|
| 9,057,256 | B2 * | 6/2015 | Ige | E21B 43/128 |
| 2010/0011876 | A1 | 1/2010 | Vyas et al. | |
| 2012/0027630 | A1 * | 2/2012 | Forsberg | E21B 43/128 417/423.3 |
| 2015/0013536 | A1 | 1/2015 | Fairuzov et al. | |
| 2015/0021014 | A1 | 1/2015 | Hughes et al. | |
| 2015/0056082 | A1 | 2/2015 | Barrios et al. | |
| 2016/0084254 | A1 | 3/2016 | Schlumberger | |
| 2016/0265321 | A1 | 9/2016 | Elmer | |
| 2018/0038214 | A1 * | 2/2018 | Collins | E21B 43/38 |
| 2018/0202432 | A1 * | 7/2018 | Slater | F04D 31/00 |

OTHER PUBLICATIONS

International Search Report and Written Opinion issued in connection with corresponding PCT Application No. PCT/US2018/032723 dated Aug. 2, 2018.

* cited by examiner

METHOD FOR PRODUCING FROM GAS SLUGGING RESERVOIRS

FIELD OF THE INVENTION

This disclosure relates generally to oil or gas producing wells, and more particularly to a system for improving the performance of an electric submersible pump in a well that exhibits periodic gas slugging events.

BACKGROUND

The use of directionally-drilled wells to recover hydrocarbons from subterranean formations has increased significantly in the past decade. With advancements in drilling technology, it is now possible to accurately drill wells with multiple horizontal deviations. Horizontal wells are particularly popular in unconventional shale plays, where vertical depths may range up to about 10,000 feet with lateral sections extending up to another 10,000 feet with multiple undulations. The geometry of the wellbore along the substantially horizontal portion typically exhibits slight elevation changes, such that one or more undulations (i.e., "peaks" and "valleys") occur.

Fluids that have filled the wellbore in lower elevations may impede the transport of gas along the length of the wellbore. This phenomenon results in an accumulation of pressure along the length of the substantially horizontal wellbore section, thereby reducing the maximum rate at which fluids can enter the wellbore from the surrounding formation. Continued inflow of fluids and gasses cause the trapped gas pockets to build in pressure and volume until a critical pressure and volume is reached, at which point a portion of the trapped gas escapes past the fluid blockage and migrates as a slug through the wellbore.

Gas slugging is particularly problematic for wells in which an electric submersible pumping system has been deployed. Typically, the submersible pumping system includes a centrifugal pump coupled to an electric motor, which is driven by a variable speed drive located on the surface. Most electric submersible centrifugal pumping systems rely on convective cooling to control the temperature of the downhole electric motor. In addition to reducing pumping rates, gas slugging may also cause the electric motor to overheat when sufficient liquid is not passed around the outside of the motor.

In the past, variable speed drives have been programmed to increase the speed of the pump when a gas slugging condition is detected. When the load on the pump increases as the gas slugging condition passes, the variable speed drive is configured to slow the operating speed of the pump. In wells that include cyclic slugging conditions, the operational pattern of accelerating and decelerating the pump increases wear on the downhole components. There is, therefore, a need for an improved system for protecting the electric submersible pumping system and optimizing the production of fluids from a reservoir that exhibits gas slugging conditions.

SUMMARY OF THE INVENTION

In one embodiment, the inventive concepts include a method of operating a submersible pumping system that includes a pump driven by an electric motor. The method includes the steps of placing the pumping system in a normal mode of operation, detecting the presence of a gas slug in proximity to the pumping system, reducing the speed of the motor, detecting the absence of a gas slug in proximity to the pumping system and then increasing the speed of the motor.

In another embodiment, the inventive concepts include a method of operating a submersible pumping system that includes a pump driven by an electric motor. In this embodiment, the method includes the steps of placing the pumping system in a normal mode of operation, detecting the presence of a gas slug in proximity to the pumping system, reducing the speed of the motor, detecting the absence of a gas slug in proximity to the pumping system, and increasing the speed of the motor. The step of detecting the absence of a gas slug includes the steps of measuring an increase in the pressure at the intake of the pump and measuring an increase in the load on the motor.

In yet another embodiment, the inventive concepts include a method of operating a submersible pumping system that includes a pump driven by an electric motor. The method includes the steps of placing the pumping system in a normal mode of operation, detecting the possible presence of a gas slug in proximity to the pumping system by measuring a decrease in the load on the motor, placing the pumping system in a reduced speed cycle, detecting the absence of a gas slug in proximity to the pumping system by evaluating two independent conditions within the pumping system and returning the pumping system to the normal mode.

DETAILED DESCRIPTION OF EXEMPLARY EMBODIMENTS

Figure 1:
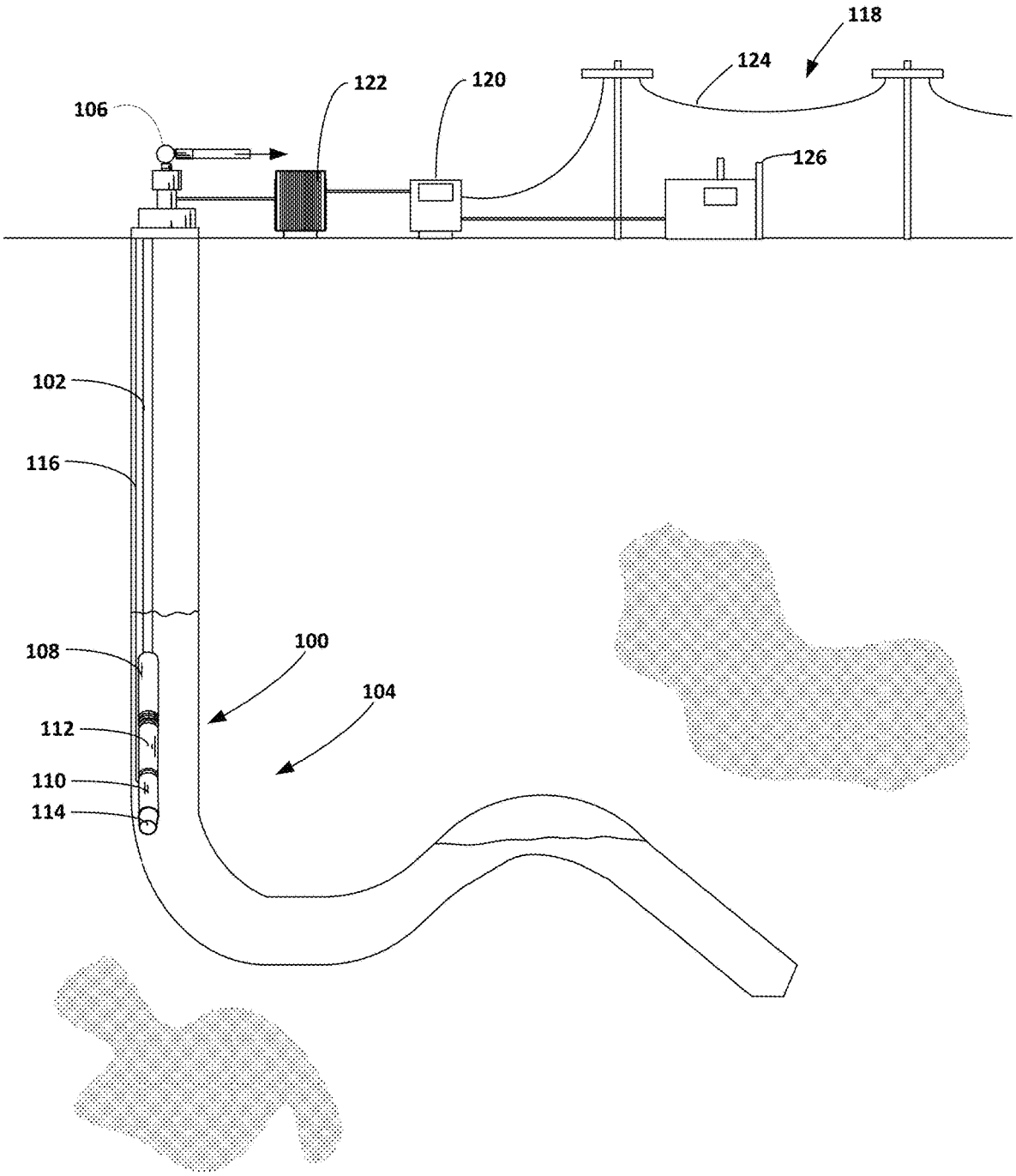
FIG. 1 is a depiction of a pumping system deployed in an undulated, non-vertical wellbore.

In accordance with exemplary embodiments of the present invention, FIG. 1 provides an elevational depiction of a pumping system 100 attached to production tubing 102. The pumping system 100 and production tubing 102 are disposed in a wellbore 104, which is drilled for the production of a fluid such as water or petroleum. The production tubing 102 connects the pumping system 100 to a wellhead 106 located on the surface. Although the pumping system 100 is primarily designed to pump petroleum products, it will be understood that the present invention can also be used to move other fluids. It will also be understood that, although the pumping system 100 of FIG. 1 is depicted in a deviated, undulated wellbore 104, the pumping system 100 and methods disclosed herein will find also utility in wellbores with other profiles. As used herein, the term "petroleum" refers broadly to all mineral hydrocarbons, such as crude oil, gas and combinations of oil and gas.

The pumping system 100 includes a pump 108, a motor 110, a seal section 112 and a sensor module 114. The motor 110 is an electric motor that receives power from surface facilities through a power cable 116. When energized, the motor 110 drives a shaft (not shown) that causes the pump 108 to operate. The seal section 112 shields the motor 110 from mechanical thrust produced by the pump 108 and provides for the expansion of motor lubricants during operation. The seal section 112 also isolates the motor 110 from the wellbore fluids passing through the pump 108.

The sensor module 114 includes one or more sensors that are configured to measure and report characteristics such as intake pressure, temperature, gas fraction, and vibration in the wellbore 104 and the pumping system 100. In some embodiments, the sensor module 114 is a forward-deployed unit that is placed upstream from the motor 110 in the wellbore 104. It will be appreciated that the pumping system 100 may include additional sensors within the motor 110, seal section 112, and pump 108. These sensors can report motor load, motor speed, discharge and intake pressures, and discharge and intake temperatures. Measurements taken in the wellbore 104 can be transmitted to the surface through the power cable 116 or through another wired or wireless conduit.

The surface facilities provide power and control to the motor 110. The surface facilities may include a power source 118, a variable speed drive (VSD) 120 and a transformer 122. The power source 118 may include one or both of a public electric utility 124 or an independent electrical generator 126. Electricity is fed by the power source 118 to the variable speed drive 120.

Figure 2:
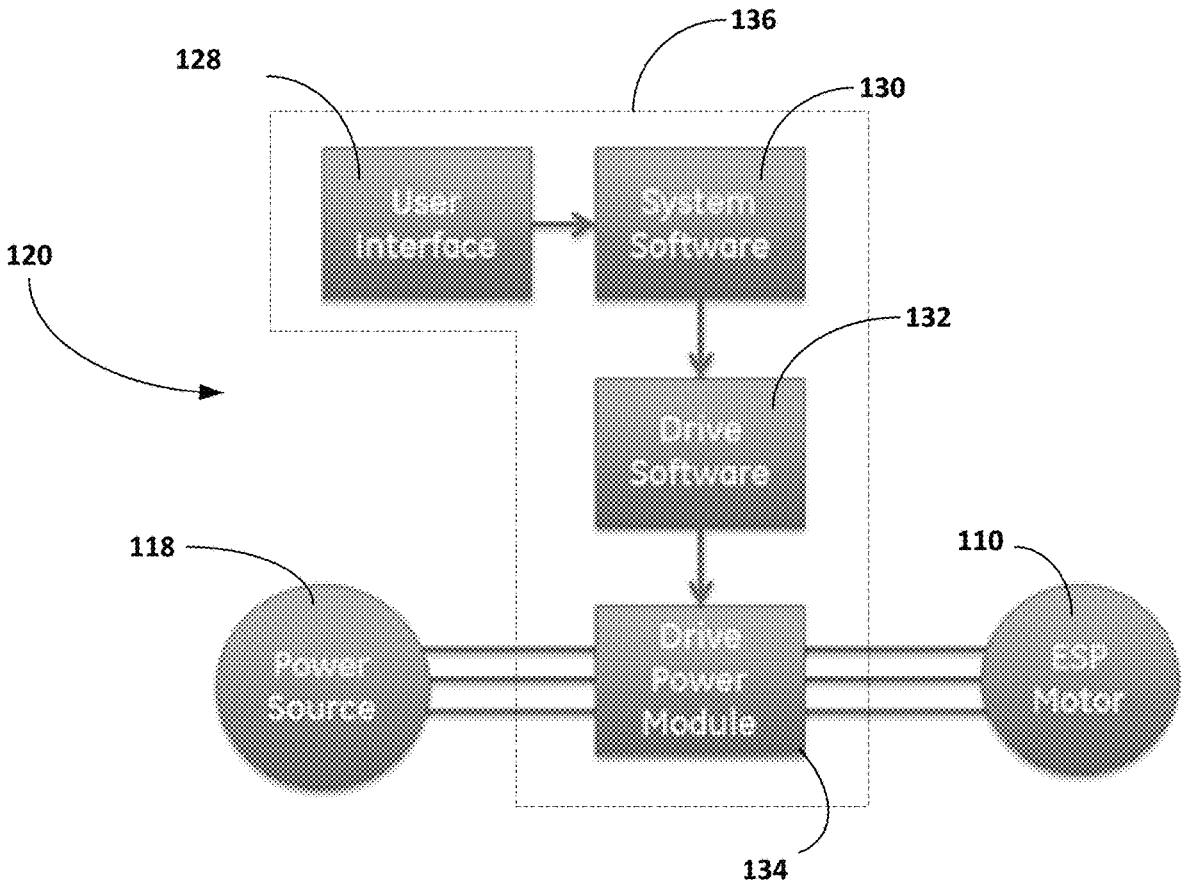
FIG. 2 is a functional block diagram of an embodiment of the motor control system.

Turning to FIG. 2, the variable speed drive 120 includes a user interface 128, system software 130 and drive software 132 that cooperatively control the operation of the drive power module 134. The drive power module 134 receives input power from the power source 118. The output of the drive power module 134 is provided to the motor 110 through the transformer 122 and power cable 116. The output of the drive power module 134 can be adjusted manually or automatically through the user interface 128, system software 130 and drive software 132 to adjust the operating parameters of the motor 110. The combination of the user interface 128, system software 130, drive software 132 and drive power module 134 are collectively referred to as the motor control system 136. As explained below, the motor control system 136 receives inputs from the sensor module 114 and other components within the pumping system 100, the power source 118 and through the user interface 128.

It will be understood that the motor control system 136 includes one or more computers and that as a general matter when the term "computer" is used herein, that term should be broadly construed to include any active device including, without limitation, a processing unit, a field programmable gate array, discrete analog circuitry, digital circuitry, an application specific integrated circuit, a digital signal processor, a reduced instruction set computer, devices with multicore CPUs, etc. The foregoing also includes distributed or parallel processing systems where multiple computers contribute to a final solution. In brief, all is required is that the computer be minimally programmable in some sense and capable of accepting input of the sort described above. The computer can some amount of local internal memory (e.g., volatile and/or non-volatile memory devices) and storage, and potentially have access to memory or storage that is connectable to it via a network. The computer may access a computer application program stored in non-volatile internal memory, or stored in an external memory that can be connected to the computer via an input/output (I/O) port. The drive software 132, system software 130 and other computer program applications may include code or executable instructions that when executed may instruct or cause the variable speed drive 120 to perform steps or functions embodying methods disclosed herein.

Additionally, it is contemplated that additional displays may be used in combination with the user interface 128 to allow a user to view and manipulate the control of the motor control system 136. The display might take place on the computer's directly-attached graphical display or, more generally, on any display device suitable for presenting graphical and text information to a user. Display devices such as table computers, smart phones, and smart terminals could also be used. In the event that the computational load of the motor control system 136 is too much for the computers within the variable speed drive 120, the computations could be done remotely and communicated via a network (e.g., wired or wireless ethernet, Bluetooth, WiFi, a web-based program executed over the Internet, etc.) to the variable speed drive 120.

Figure 3:
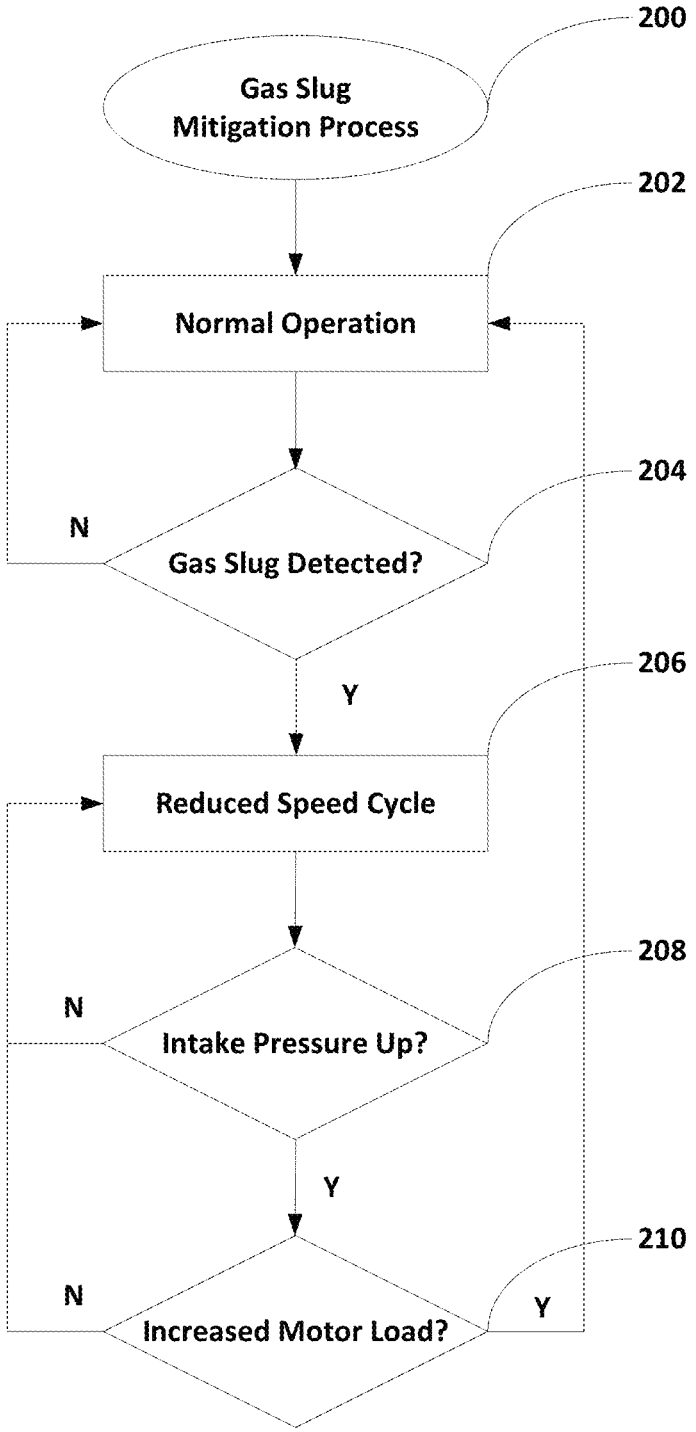
FIG. 3 is a functional block diagram of an overview of the optimized motor control process.

Based on measurements from the wellbore 104, the motor control system 136 is configured to carry out a gas slug mitigation control process for optimizing the operation of the pumping system 100 during a gas slugging event. An overview of the gas slug mitigation control process is outlined in the flowchart in FIG. 3. In this embodiment, the process 200 begins at step 202, where the pumping system 100 is operating under normal conditions before a gas slugging event has occurred. At decision step 204, the motor control system 136 determines whether a gas slugging event has taken place. The detection of a gas slug passing through the wellbore 104 near the pumping system 100 can be determined using a variety of measurements. For example, a decrease in the intake pressure at the pump 108 or a reduction in the load on the motor 110 may indicate a gas slug in the proximity of the pumping system 100.

Once a gas slugging condition has been detected, the process 200 moves to the reduced speed cycle at step 206 and the speed of the motor 110 and pump 108 is reduced. The process 200 continues with the pump 108 operating at the reduced speed until decision block 208, which queries whether the intake pressure at the pump 108 has increased above a threshold amount over an established period. An increase in intake pressure may signal the presence of additional liquid at the pump 108, which may indicate that the gas slug has passed the pumping system 100. If an increase in the intake pressure is not detected, the process 200 returns to step 206 and the pumping system 100 continues to operate in the reduced speed cycle.

If the intake pressure has increased beyond the threshold amount, the process 200 moves to step 210 and the load on the motor 110 and pump 108 is queried. During this step 210, the operating speed of the motor 110 and pump 108 may be temporarily increased to help determine if there is an increase on the motor 110 and pump 108 load. If the load on the motor 110 has increased, thereby signaling that the gas slug has passed, the process 200 returns to step 202 and the pumping system 100 is placed back in normal operation. Thus, the gas slug mitigation control process 200 provides for the reduction of the operating speed of the pumping system 100 if a gas slugging event is detected and maintains the reduced operating speed until the gas slug has passed the pumping system 100, as indicated by an increase in the intake pressure at the pump 108, as confirmed by an increase in the load on the motor 110. In an exemplary embodiment, the gas slug mitigation control process 200 controls the speed of the motor 110 and pump 108 based on real-time measurements of various wellbore and operational characteristics rather than on a simple timer that does not receive input from the wellbore 104.

Figure 4:
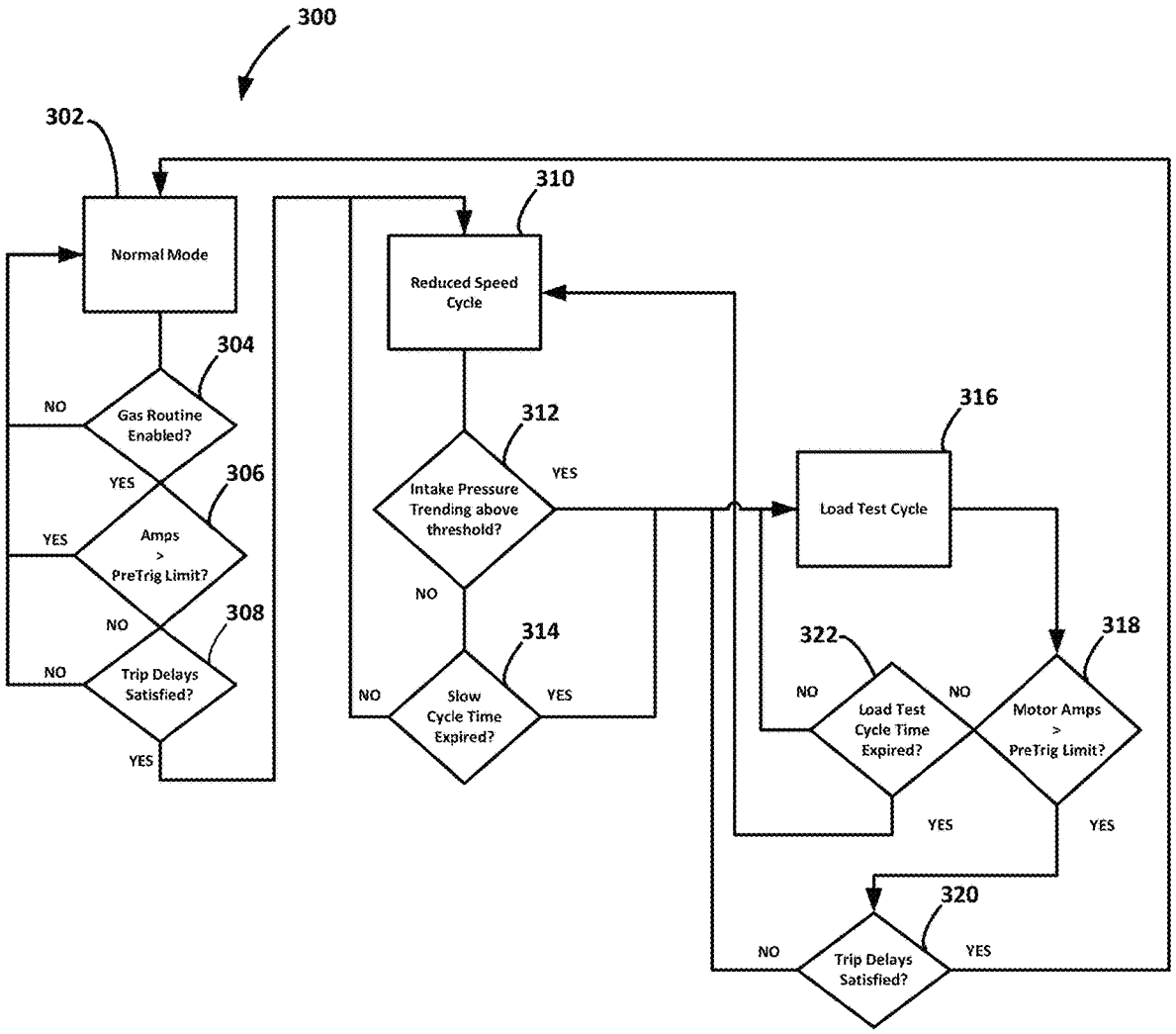
FIG. 4 is a functional block diagram of a first embodiment of the optimized motor control process.

Turning to FIG. 4, shown therein is a process flow chart for a more detailed embodiment of the gas slug mitigation control process. The process 300 begins at block 302 with the pumping system 100 operating in "Normal Mode." At decision step 304 the motor control system 136 determines if the pumping system control process 300 has been enabled within the variable speed drive 120. If so, the process 300 moves to step 306, where the load on the motor 110 is compared against a threshold value. If the load on the motor 110 remains above the threshold value, the process 300 returns to block 302 and the normal operation of the pumping system 100 continues.

If, however, the load on the motor 110 drops below the threshold amount, the process 300 passes to decision step 308. At step 308, the motor control system 136 determines if the detection of a decreased load on the motor 110 has persisted for longer than a preset delay period. The delay period is intended to prevent the motor control system 136 from unnecessarily changing the operational parameters of the pumping system 100 in response to a transient drop in the motor load not caused by a gas slugging event.

Once the delay period has passed and the load on the motor 110 is still below the threshold value, the process 300 passes to the reduced speed cycle at block 310 and the motor control system 136 reduces the speed of the motor 110 and pump 108. This reduces the operating temperature of the motor 110 and reduces wear on the various components within the pumping system 100. The pumping system 100 is held in the reduced speed cycle until the motor control system 136 determines that the slugging event is likely to have passed using two independent measurements.

Once the pumping system 100 is in the reduced speed cycle, the process 300 moves to decision block 312, where the motor control system 136 determines whether the intake pressure at the pump 108 is trending above the threshold values over a preset period of time. Alternatively or additionally, the motor control system 136 can determine whether the slope of the rate of change of the intake pressure of the pump 108 remains positive for a predetermined period, which may indicate an increasing intake pressure of the pump 108. Evaluating the slope of the change in intake pressure may be less susceptible to error than using discrete intake pressure measurements, which may fluctuate over time due to changes in the wellbore 104. If the intake pressure is trending above the threshold values, the process 300 passes to the motor load test cycle at block 316.

If the intake pressure is not trending above the threshold values at decision block 312, the process 300 optionally moves to decision step 314, where the motor control system 136 determines whether a preset timer has expired for the reduced speed cycle. In certain situations, the passage of the gas slug may not be readily apparent from only reviewing the gradual change in the intake pressure at the pump 108. If the timer has expired, the process 300 moves from step 314 to the motor load test cycle at block 316. If the slow cycle timer has not yet expired, the process 300 returns to block 310 and the pumping system 100 continues to operate at the reduced speed while looking for a trending increase in the intake pressure at the pump 108. The motor control system 136 can be configured to determine whether the slope of the pump 108 intake pressure curve is negative. Using this approach, the motor control system 136 can determine that the pump intake pressure is likely to be "bottoming out" as the slope decreases even if the intake pressure is still dropping.

At block 316, the motor control system 136 shifts into an operational mode in which the load on the motor 110 is used to evaluate the status of the pumping system 100. In this operational mode, the speed on the motor 110 may be increased to better assess a change in the load on the motor 110. The motor 110 can be placed into a current-control mode in which the motor control system 136 attempts to find a particular current level, or the motor 110 can be controlled under a constant frequency mode. At block 318, the motor control system 136 determines whether the load on the motor 110 exceeds the threshold value for identifying a gas slugging event. The load on the motor 110 can be evaluated in a number of ways, including by measuring the electric current consumed by the motor 110.

If the load on the motor 110 exceeds the threshold value, the process moves to decision step 320, where the motor control system 136 determines if the detection of an increased load on the motor 110 has persisted for longer than a preset delay period. The delay period is intended to prevent the motor control system 136 from unnecessarily changing the operational parameters of the pumping system 100 in response to a transient increase in the motor load not caused by the cessation of a gas slugging event. If the delay period has passed at step 320, the process 300 returns to step 302 and the pumping system 100 is placed back into normal operating mode.

If at step 318 the load on the motor 110 does not exceed the threshold, the process 300 moves to the load test cycle timer step 322, where the motor control system 136 determines whether a preset timer has expired for the load test cycle. If the load test cycle timer has not expired, the process 300 moves back to step 316 and the motor control system 136 continues to look for an increased load on the motor 110 at step 318. If, however, the load test cycle timer has expired, the process 300 returns to block 310 and the pumping system 100 continues to operate at the reduced speed and the motor control system 136 reverts back to monitoring the intake pressure at the pump 108.

Figure 5:
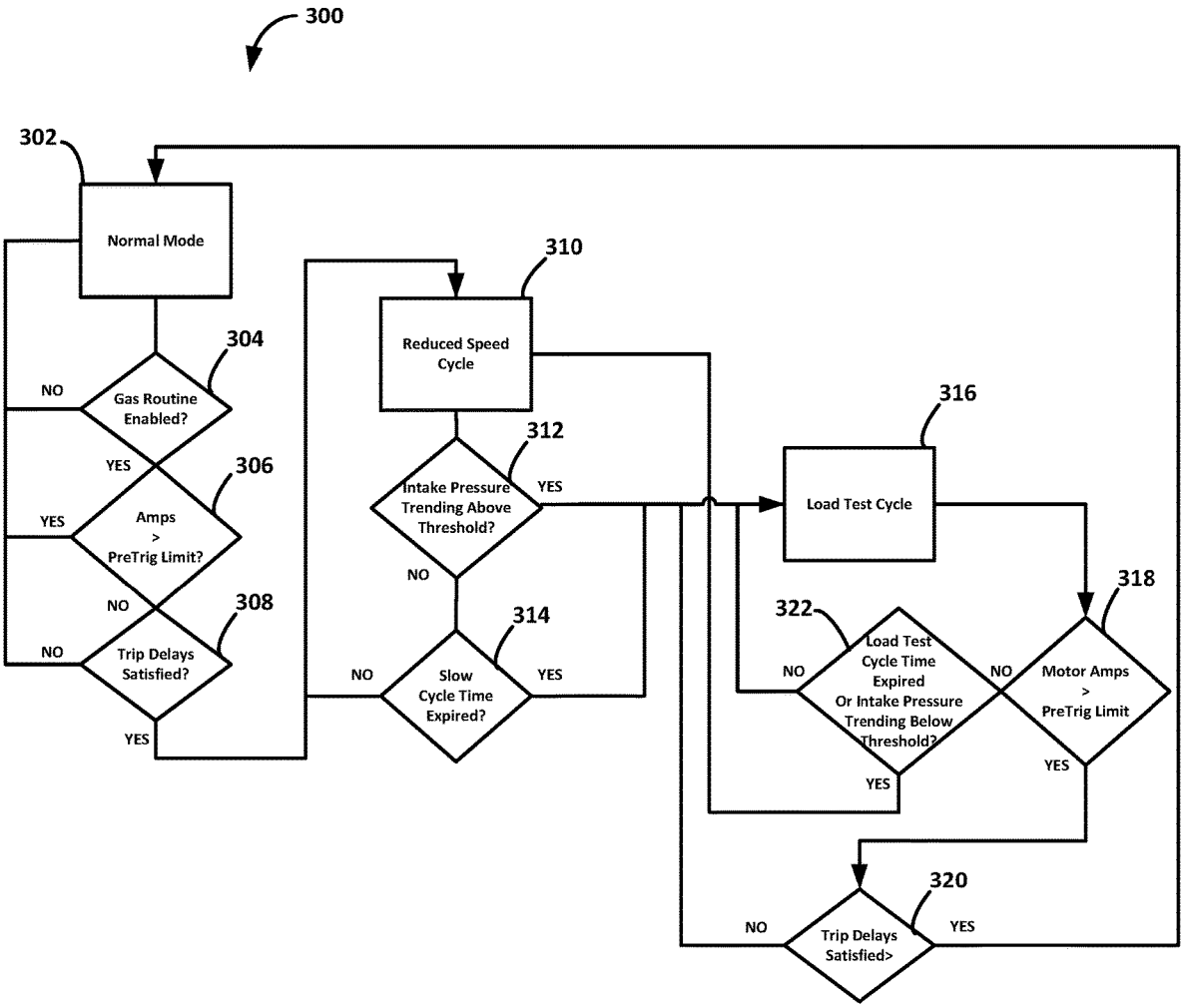
FIG. 5 is a functional block diagram of a second embodiment of the optimized motor control process.

As depicted in FIG. 5, the decision step 322 can be configured to alternatively test for two conditions: the expiration of the load test cycle timer or a decrease in the intake pressure of the pump 108 below the threshold amount. In this embodiment, if either condition occurs, the process 300 returns to block 310 and the pumping system 100 continues to operate at the reduced speed. If neither condition occurs, the process 300 returns to block 316 and the motor control system 136 continues to evaluate whether the load on the motor 110 is increasing.

Thus, the process 300 switches to the reduced speed cycle 310 after the motor control system 136 confirms the existence of a gas slugging event based on a persistently reduced load on the motor 110 at steps 306 and 308. The pumping system 100 operates under the reduced speed cycle until either the intake pressure increases beyond a threshold amount (at step 312) or the reduced speed cycle timer expires (at step 314). In both cases, the motor control system 136 then moves into a load test cycle at step 316, where the load on the motor 110 is compared against a threshold amount. If the load on the motor 110 is consistently above the threshold amount for a present amount of time, the motor control system 136 places the pumping system 100 back into normal operating mode at step 302. If the load on the motor 110 has not increased above the threshold amount following the expiration of the load test cycle timer at step 322, the process 300 returns to step 310 and the motor control system 136 looks for an increase in the intake pressure of the pump 108.

The process 300 as implemented by the motor control system 136 thus provides an agile process for quickly placing the pumping system 100 into a reduced speed cycle upon the confirmed detection of a gas slugging event as determined by a drop in the load on the motor 110. The pumping system 100 is held in the reduced speed cycle until the gas slugging event has passed as determined by an increase in the intake pressure of the pump 108 and as confirmed by an increase in the load on the motor 110. The gas slug mitigation control process can be implemented as programming within the variable speed drive 120 and the various thresholds, timers and other settings used to adjust the process can be manipulated through the user interface 128.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A method of operating a submersible pumping system that includes a pump driven by an electric motor, the method comprising the steps of:

placing the pumping system in a normal mode of operation;

detecting the presence of a gas slug in proximity to the pumping system;

reducing the speed of the motor;

detecting the absence of a gas slug in proximity to the pumping system, wherein the step of detecting the absence of a gas slug comprises:

measuring an increasing slope of a curve representing the pump intake pressure over time; and measuring an increase in the load on the motor over an established period; and increasing the speed of the motor.

2. The method of claim 1, wherein the step of detecting the presence of a gas slug further comprises measuring a decrease in the load on the motor.

3. The method of claim 2, wherein the step of measuring a decrease in the load on the motor comprises measuring a decrease in the load on the motor over an established period.

4. The method of claim 1, wherein the step of detecting the presence of a gas slug comprises measuring a decreasing slope of a curve representing the pump intake pressure over time.

5. The method of claim 1, wherein the step of detecting the absence of a gas slug comprises measuring an increase in the pressure at the intake of the pump and an increasing slope of a curve representing the pump intake pressure over time.

6. The method of claim 5, wherein the step of detecting the absence of a gas slug further comprises:

increasing the speed of the motor; and measuring an increase in the load on the motor.

7. The method of claim 6, wherein the step of measuring an increase in the load on the motor occurs after the step of measuring an increase in the pressure at the intake of the pump.

8. A method of operating a submersible pumping system that includes a pump driven by an electric motor, the method comprising the steps of:

placing the pumping system in a normal mode of operation;

detecting the presence of a gas slug in proximity to the pumping system;

reducing the speed of the motor;

detecting the continued presence of a gas slug in proximity to the pumping system, wherein the step of detecting the continued presence of a gas slug comprises:

measuring an increase in the slope of a curve representing the pump intake pressure over time; and placing the motor in a load test cycle, wherein the load test cycle comprises the steps of:

determining if the load on the motor exceeds an established load value; and comparing the pump intake pressure against an established pressure value;

detecting the absence of a gas slug in proximity to the pumping system, wherein the step of detecting the absence of a gas slug comprises:

measuring an increase in the slope of a curve representing the pump intake pressure over time; and measuring an increase in the load on the motor; and returning the pumping system to the normal mode of operation.

9. The method of claim 8, wherein the step of detecting the presence of a gas slug comprises measuring a decrease in the load on the motor.

10. The method of claim 8, wherein the step of detecting the presence of a gas slug comprises measuring a decreasing slope of a curve representing the pump intake pressure over time.

11. The method of claim 8, wherein the step of measuring an increase in the pressure at the intake of the pump further comprises measuring an increasing pressure above a threshold amount over a present period.

12. The method of claim 8, wherein the step of measuring an increase in the load on the motor occurs after the step of measuring an increase in the pressure at the intake of the pump.

13. A method of operating a submersible pumping system that includes a pump driven by an electric motor, the method comprising the steps of:

placing the pumping system in a normal mode of operation;

detecting the possible presence of a gas slug in proximity to the pumping system by measuring a decrease in the load on the motor;

placing the pumping system in a reduced speed cycle;

detecting the absence of a gas slug in proximity to the pumping system by evaluating two independent conditions within the pumping system, wherein one of the independent conditions is a decrease in the slope of a curve representing the pump intake pressure over time; and returning the pumping system to the normal mode.

14. The method of claim 13, wherein the step of detecting the absence of a gas slug further comprises:

detecting an increase in the intake pressure of the pump; and detecting an increase in the load on the motor.

15. The method of claim 14, wherein the step of detecting an increase in the intake pressure of the pump further comprises waiting for an increase in the intake pressure of the pump for a first preset period of time.

16. The method of claim 15, wherein the step of detecting an increase in the load on the motor further comprises waiting for an increase in the load on the motor for a second preset period of time.

17. The method of claim 15, further comprising the steps of adjusting the first and second preset periods of time using a user interface within a motor control system.

* * * * *